United States Patent [19]

Anderson

[11] Patent Number: 4,461,124

[45] Date of Patent: Jul. 24, 1984

[54] AUTOMATIC OR MANUAL FOUR-AXES SANDING MACHINE SYSTEM FOR SANDING AND/OR FINISHING A VERTICALLY HELD CONTOURED PART

[75] Inventor: David A. Anderson, Sumner, Wash.

[73] Assignee: The Boeing Company, Seattle, Wash.

[21] Appl. No.: 352,729

[22] Filed: Feb. 26, 1982

[51] Int. Cl.[3] ..... B24B 51/00

[52] U.S. Cl. ..... 51/165 R; 51/215 E

[58] Field of Search ..... 51/170 R, 165 R, 87 R, 51/78, 66, 39, 40, 215 R, 215 E

[56] References Cited

U.S. PATENT DOCUMENTS

| | | | |
|---|---|---|---|
| 2,269,197 | 1/1942 | Hamilton | 51/40 |
| 2,881,570 | 4/1959 | Moore et al. | 51/87 R |
| 3,509,667 | 5/1970 | Lindmark | 51/178 |
| 3,597,881 | 8/1971 | Olton et al. | 51/39 |
| 3,717,892 | 2/1973 | Johnson | 10/89 F |
| 3,807,098 | 4/1974 | Schaller et al. | 51/165.71 |
| 3,823,455 | 7/1974 | McIlrath et al. | 51/178 |
| 4,050,196 | 9/1977 | Theurer | 51/178 |

*Primary Examiner*—Roscoe V. Parker

*Attorney, Agent, or Firm*—Conrad O. Gardner; Bernard A. Donahue

[57] ABSTRACT

A vertical wing skin sanding machine which includes one or more sanding stations, dust/sound enclosure, operator console, and dust collectors all mounted on a common trolley designed to travel a linear path over the required length. The system provides an opening bisecting the device to allow for finishing the stationary part on both sides of the part. The system provides a mechanical means of propulsion of the device and guide rolls to stabilize, sound damp, and direct the part by the finishing wheel.

8 Claims, 10 Drawing Figures

AUTOMATIC OR MANUAL FOUR-AXES SANDING MACHINE SYSTEM FOR SANDING AND/OR FINISHING A VERTICALLY HELD CONTOURED PART

The present invention relates to vertical wing skin sanding methods and apparatus and, more particularly, to a vertical wing skin sanding system which provides an opening bisecting the device to allow for finishing the stationary part on both sides of the part including means of propulsion of the device and guide rolls to stabilize and direct the part by the finishing wheels.

Prior attempts to solve the problem of vertical wing skin sanding over the last twenty years have included floor sanders and hand sanding in a lay down position. Those methods are both labor intensive and require excessive floor space. Recent attempts have included a multiple disc rotary counterbalanced sanding head. This method required an elevated platform and ten operators; it was neither efficient nor capable of maintaining the production rate required.

In the patent literature, U.S. Pat. Nos. 3,807,098 and 3,717,892 teach the use of master control systems for automatic grinding and finishing operations, while U.S. Pat. Nos. 2,269,197; 2,881,570; and 3,823,455 describe the use of flap wheels and buffers being mechanically directed to accomplish the finishing operation over a contoured area.

In contrast, the present sanding machine system includes means for sanding vertically held contoured wing skin by shot peen and further includes methods and apparatus for transporting the wing skin and lowering it into the wing skin sanding machine.

In accordance with a preferred embodiment of the invention, an operator sets a set of heads (two sets per side) for the predetermined area of desired sanding operation. The operator adjusts the height (Y motion), radial (C motion) and feed rate of the machine (X motion). The spindles are set at a predetermined RPM and the machine feed (X) motion is started; each abrasive head is then brought into contact (Z motion) by air pressure to the part. In accordance with preferred embodiment, the air pressure is controlled during the sanding pass for metal removal rate, the system automatically compensating for variances in nominal thickness ($\pm\frac{1}{2}$ inch) while the operator makes adjustment for major deviations.

A full understanding of the invention, and of its further objects and advantages and the several unique aspects thereof, will be had from the following description when taken in conjuction with the accompanying drawings in which:

FIG. 2 is a right side view of the present sanding system, with the right side and access door of the sound enclosure removed, showing the rail and rail trucks the machine moves on;

Figure 7:
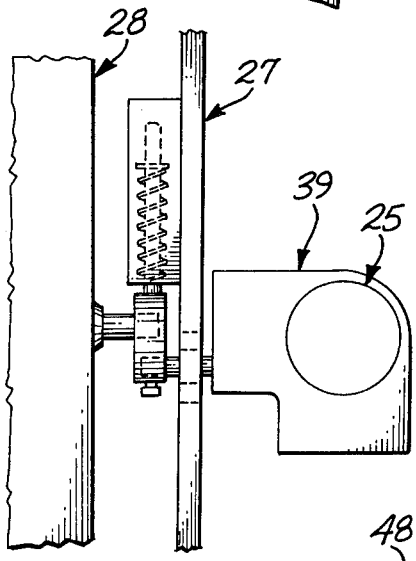
FIG. 7 is an illustration of the method of oscillation for each sanding wheel in the sanding system.
Figure 10:
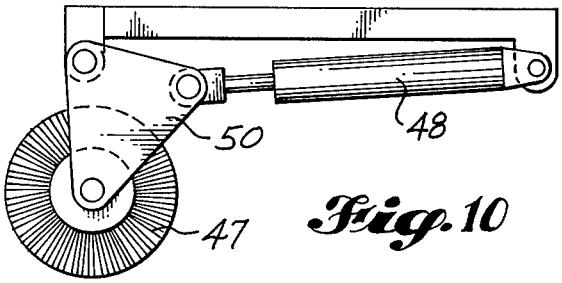
Figure 9:
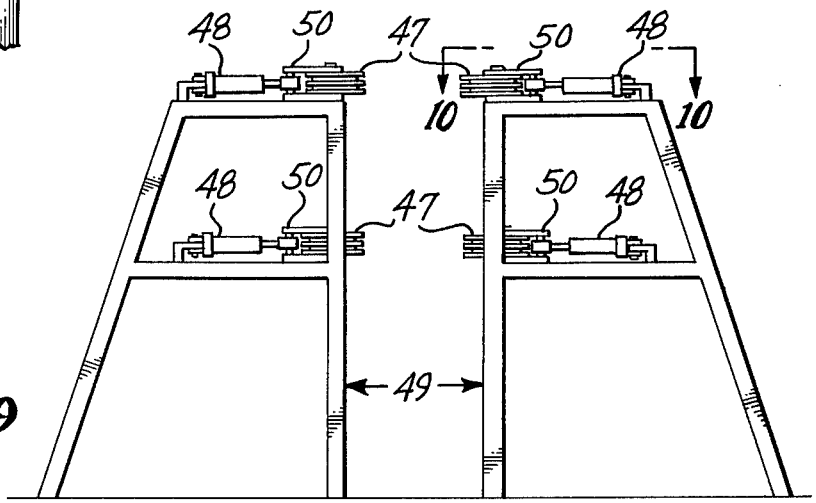
FIG. 9 is an illustration of typical guide roll station of the present vertical wing skin sanding system shown in FIGS. 1–5 and 7; and, FIG. 10 is a top sectional view of FIG. 9 showing the guide roll assembly.
Figure 8:
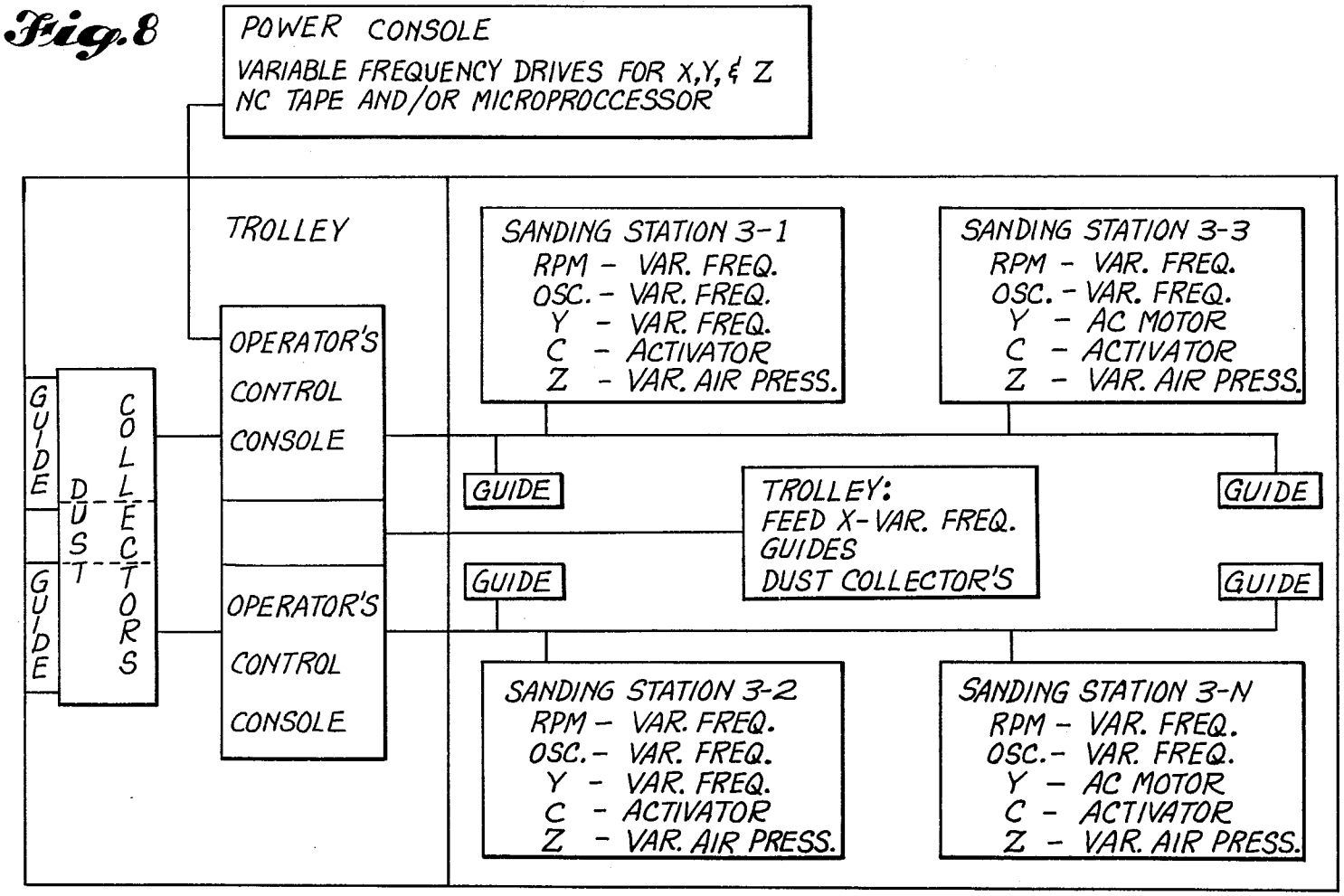
FIG. 8 is a block diagram of the control system portion of the present sanding system shown in FIGS. 1–5 and 7.

The sanding machine which is a preferred embodiment of the present invention, as shown in structural detail in FIGS. 1–5, 7 and 9 with control system therefor shown in FIG. 8, comprises an automatic or manual four-axes sanding system for sanding and/or finishing a vertically held contoured part. The machine is operational in finishing of parts of varying length (four to 110 feet), varying height (one to nine feet), varying thickness (0.03 to seven inches), and varying contour (span and chordwise up to an eighth inch deviation from centerline).

The present sanding machine is capable of deburring, radiusing, finishing and blending to the required specifications with a discontinuous scratch pattern. The machine configuration, in accordance with the hereinafter described preferred embodiment, automatically compensates for deviations in nominal part thickness and will remove material to a tolerance of $\pm 0.002$ inch over the entire part length.

Turning to FIG. 8, the machine consists of one or more sanding stations enclosed within a dust/sound enclosure, two operator elevators and control consoles, and two dust collectors, all mounted on a common trolley designed to roll upon a floor-mounted rail system. Each sanding station consists of two counter-rotating abrasive wheels mounted on a column. Each sanding station operates in three axes: height "Y", radial "C", and toward the centertine of the machine "Z", while length "X" is handled by the common trolley.

Each abrasive wheel preferably comprises a series of coated abrasive segments mounted on a common hub removable from the spindle by means of a threaded nut. Though coated abrasives are preferable, other finish means may be utilized.

Figure 6:
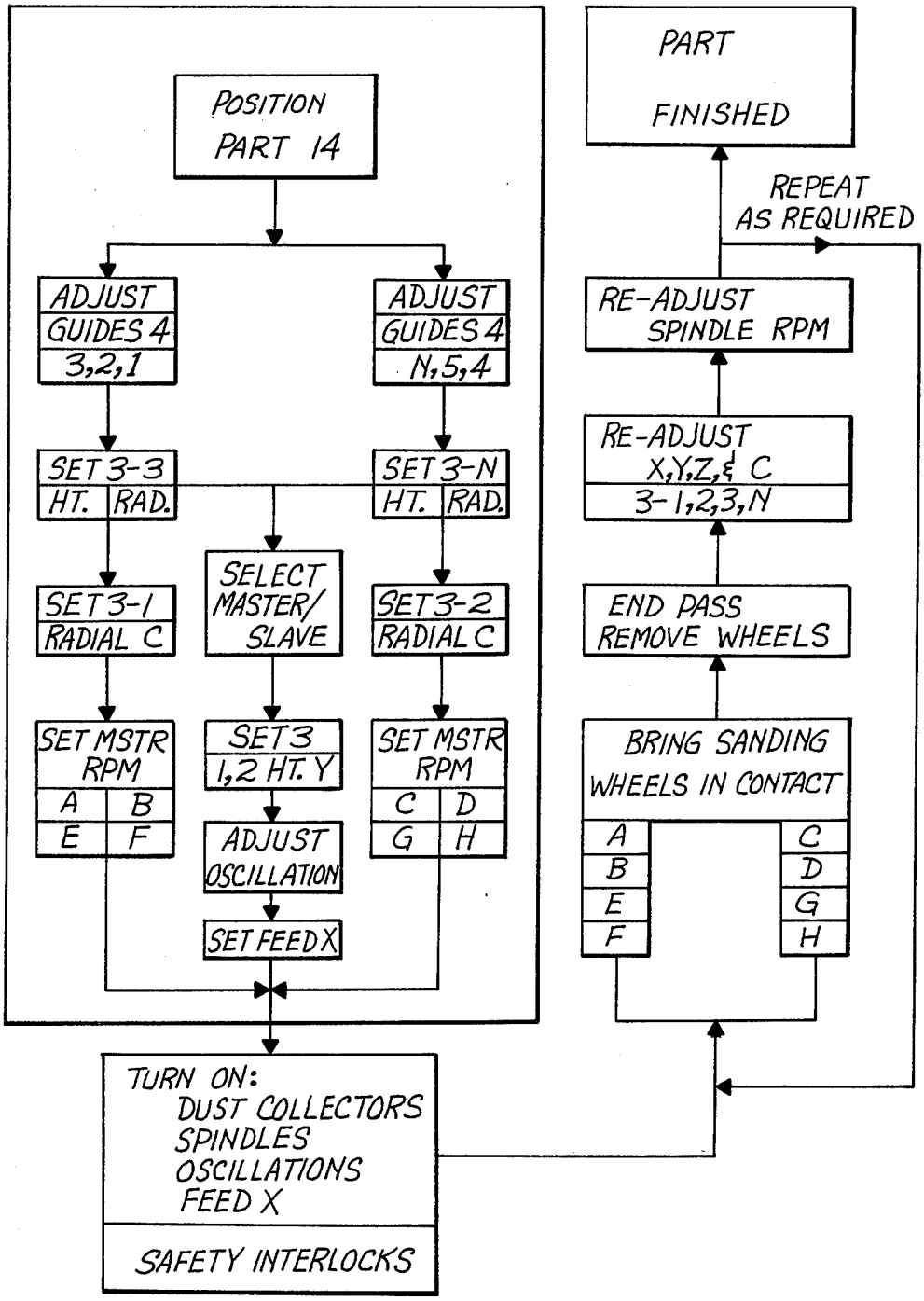
FIG. 6 is a block diagram of the operational procedure for the sanding system shown in FIGS. 1–5 and 7.

FIG. 6 is illustrative of a typical operation sequence of the present vertical wing skin sanding system. If should be noted that this operation sequence can be operated manually or automatically by means of a device such as a numerical control tape or microprocessor. Each station has an optical encoder for position on each axis with "X" motion optical encoder mounted on the common trolley. The overall system has been set up for optical identification of part type and nomenclature with the part set up point found by means of a proximity of optical indicators, such as manufactured by Sundstrand Inc. or NCR Inc.

In the manual mode, the two operators position part 14, bring their respective guides 4 into contact with the part for vertical positioning within the machine. The sanding stations 3-3 and 3-N are then positioned for proper height "X" and radial angle "C" and station 3-1 and 3-2 are brought within the same plane "Y" and "C". At this point the operators must select which operator shall be in master/slave condition. This is required to set the proportional angularity control for stations 3-1 and 3-2, oscillation frequency for all stations, and machine feed "X" rate. The proportional angularity control is a variable frequency drive controlling the Y motors 19 on stations 3-1 and 3-2 which is, in turn, controlled by the "X" motion variable frequency drive motor 7. This ensures that sanding stations 3-1 and 3-2 will follow a lower edge lengthwise angle of the part 14 if required.

Both operators then select the proper spindle revolutions per minute (RPM) for their respective spindles. The dust collectors 10, sanding station spindle motors 26 and oscillation motors 25, and feed motor 7 are then turned on. A safety interlock system continuously ensures that a safe operation can be carried out.

As the machine starts its pass along the part 14, the operators bring each sanding wheel into contact with the part 14 at a predetermined air pressure. This air pressure may be varied by the operators or tape control for gross deviations in the part 14 such as openings. Normally, this variation is not required as the machine automatically compensates for part deviation over nominal thickness.

At the end of the pass, the operators remove the sanding wheels from the part, re-adjust the sanding station for the next pass on the "Y", "Z", and "C" axes, re-adjust the feed "X" rate and spindle RPM, if required, and start the next pass. This continues until the part 14 is completed.

It should be noted that as the number of sanding stations 3 in cascade is increased, fewer passes over the part 14 would be required. It should also be noted that the machine does not necessarily have to move by the part but that the part can be moved through the machine with the machine being stationary.

There are three double sets of guide roll stations 4 set up at either end and the middle of the machine. The purpose of these guides 4 is to direct and support the part 14 into and through the machine. However, they also provide for sounding damping of the part 14. They are set at staggered heights throughout the machine, but opposite sets are the same height. Sheet material parts 14 have a tendency to vibrate in symphony to the abrasive wheels with that vibration magnifying in loudness down the length of the part. As the guide rolls are made of a flexible material, edge patterned cut, and set at staggered heights, that sympathetic vibration is dampened.

Figure 1:
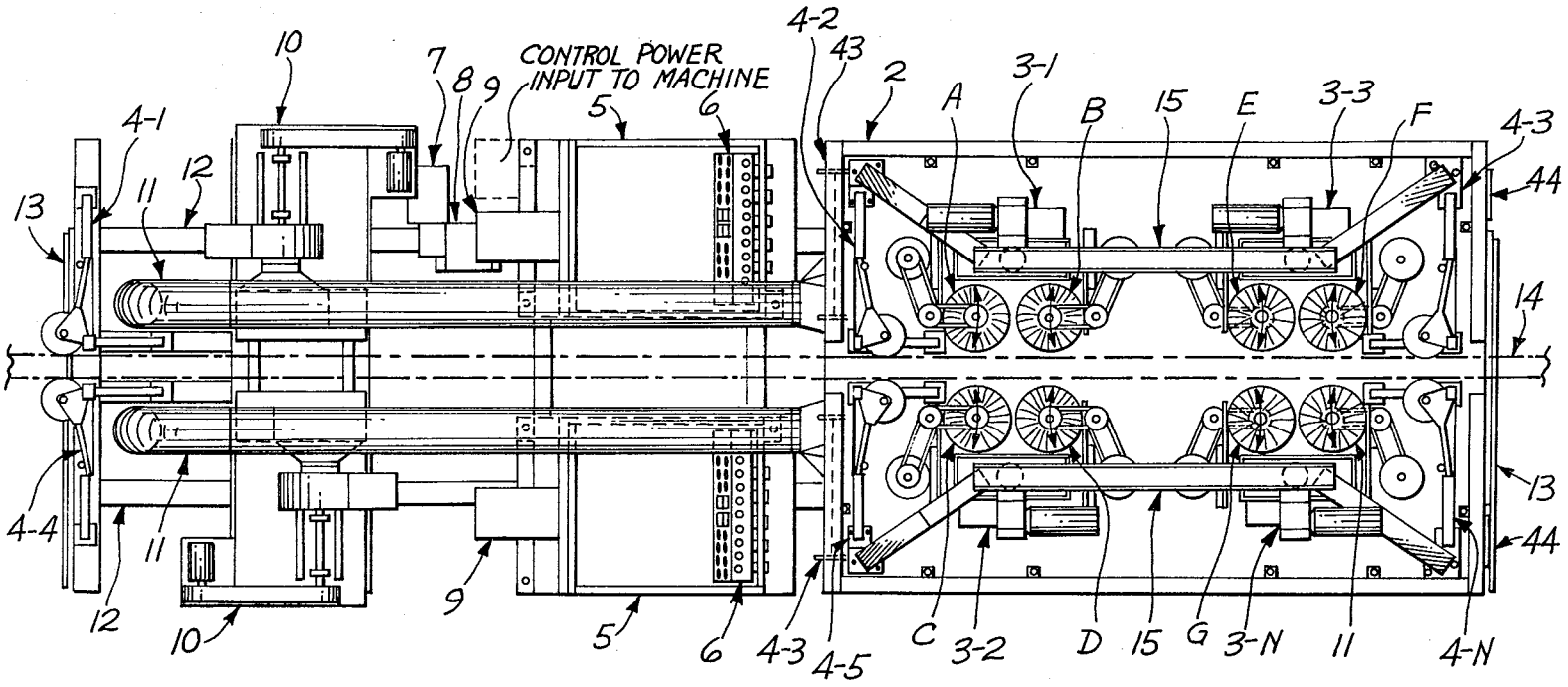
FIG. 1 is a top plan view of the present vertical sanding machine system including operating stations and dust collection system.

FIG. 1 is illustrative of the present vertical sanding system feature of travel down the length of the stationary part 14 with a plurality of sanding stations 3 mounted on a trolley. For convenience, only four sanding stations have been illustrated, but it will be appreciated that any number of stations, 1, 2, 3, 4, . . . N may be located in cascade to sand a common part on a common pass line. Each illustrated sanding station 3 is further identified by a number identifying its particular station 1, 2, 3, . . . N in the cascade system. To keep the part 14 centered within the sanding system, there is a plurality of staggered guide roll sets 4. Each sanding station is braced by means of weldment 15. Only six sets have been illustrated but it will be appreciated that any number 1, 2, 3, . . . N may be utilized as the sanding stations 3 are increased. Each guide roll set is further identified by a number identifying its particular position 1, 2, 3, . . . N.

Figure 5:
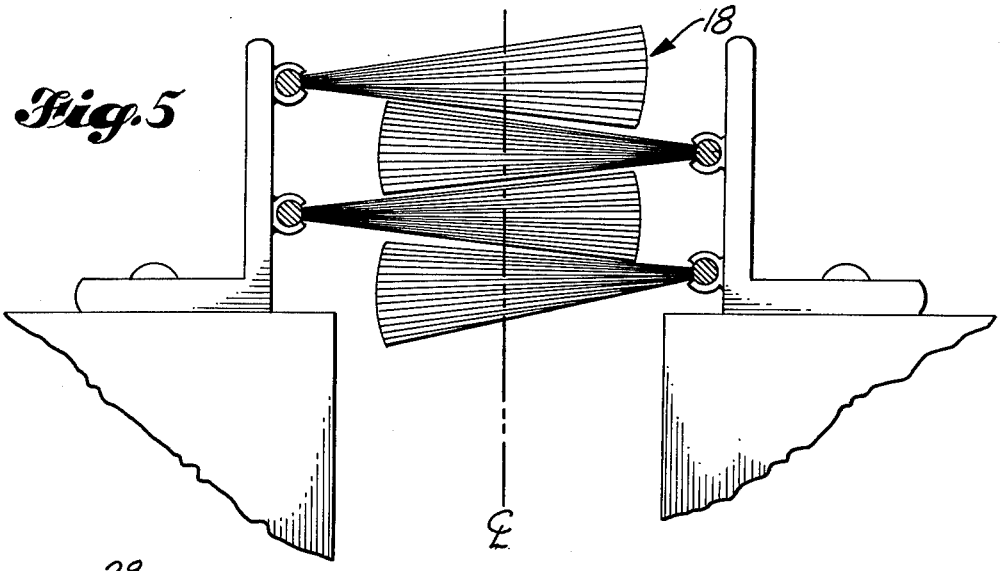
FIG. 5 is an illustration of the dust enclosure brush mounting system surrounding the dust/sound enclosure on three sides: top, front, and rear.

The sanding stations 3 and guide rolls 4 are enclosed within a sound enclosure 2 with the enclosure dust sealed by a series of overlapping (as seen in FIG. 5) flexible brushes 18 designed to allow passage of the part 14 with a minimum amount of air seepage. This dust/sound enclosure 2, sanding stations 3, and guide rolls 4 are mounted on a baseplate 42 and fastened to trolley 12.

Behind the dust/sound enclosure on the common trolley 12 are two operator-controlled elevators 5 and control consoles 6, operated vertically by lift motors 9. Behind the operator control stations are two water-based dust collectors 10. These dust collectors 10 are connected to the sound/dust enclosure through duct work 11 with the volume of air controlled by sliding access windows 44 and inlet 41. At either end of the trolley 12 are two safety bumpers 13 designed to prevent the trolley from destroying anything in its path.

Figure 2:
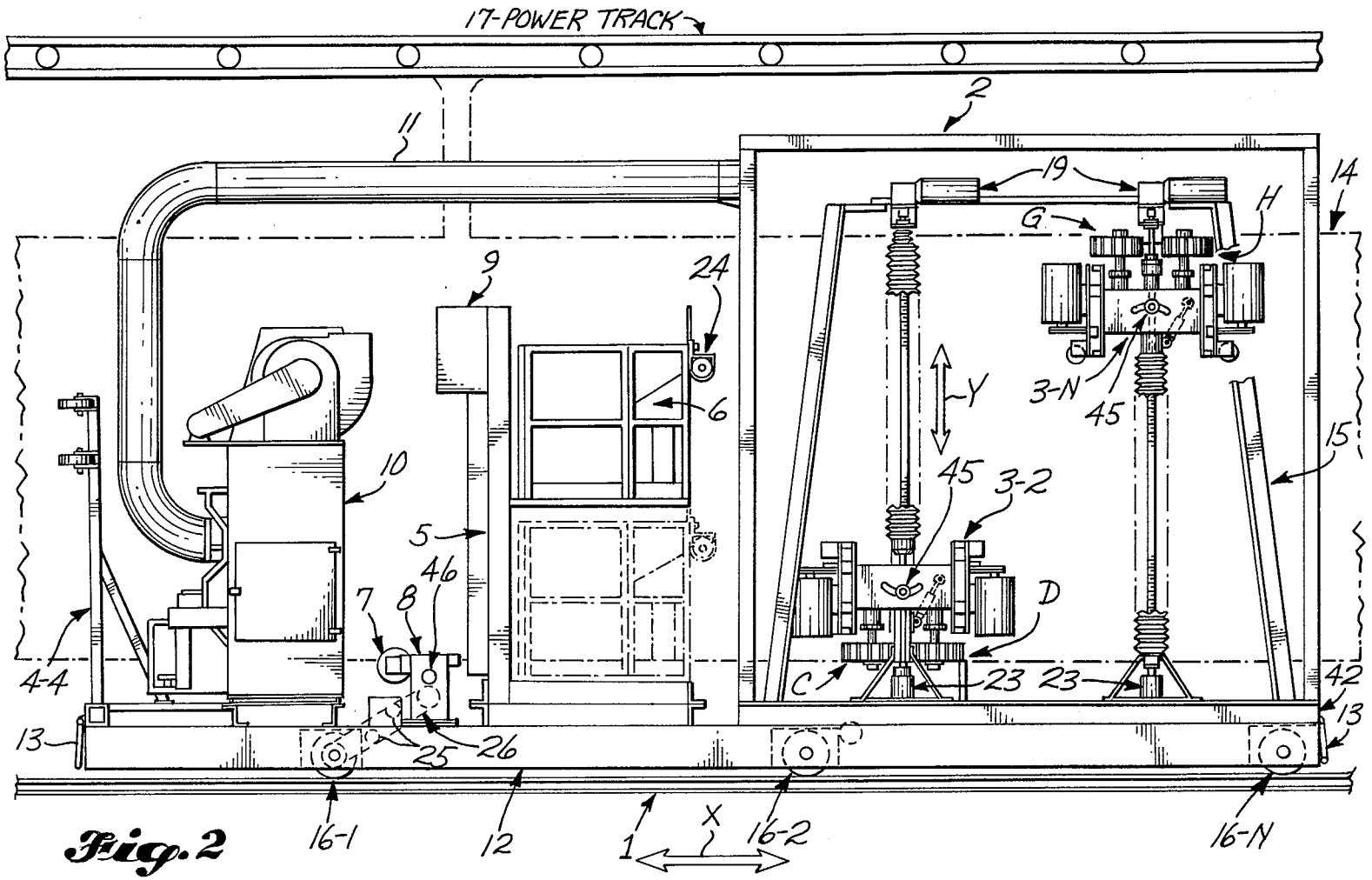
Figure 3:
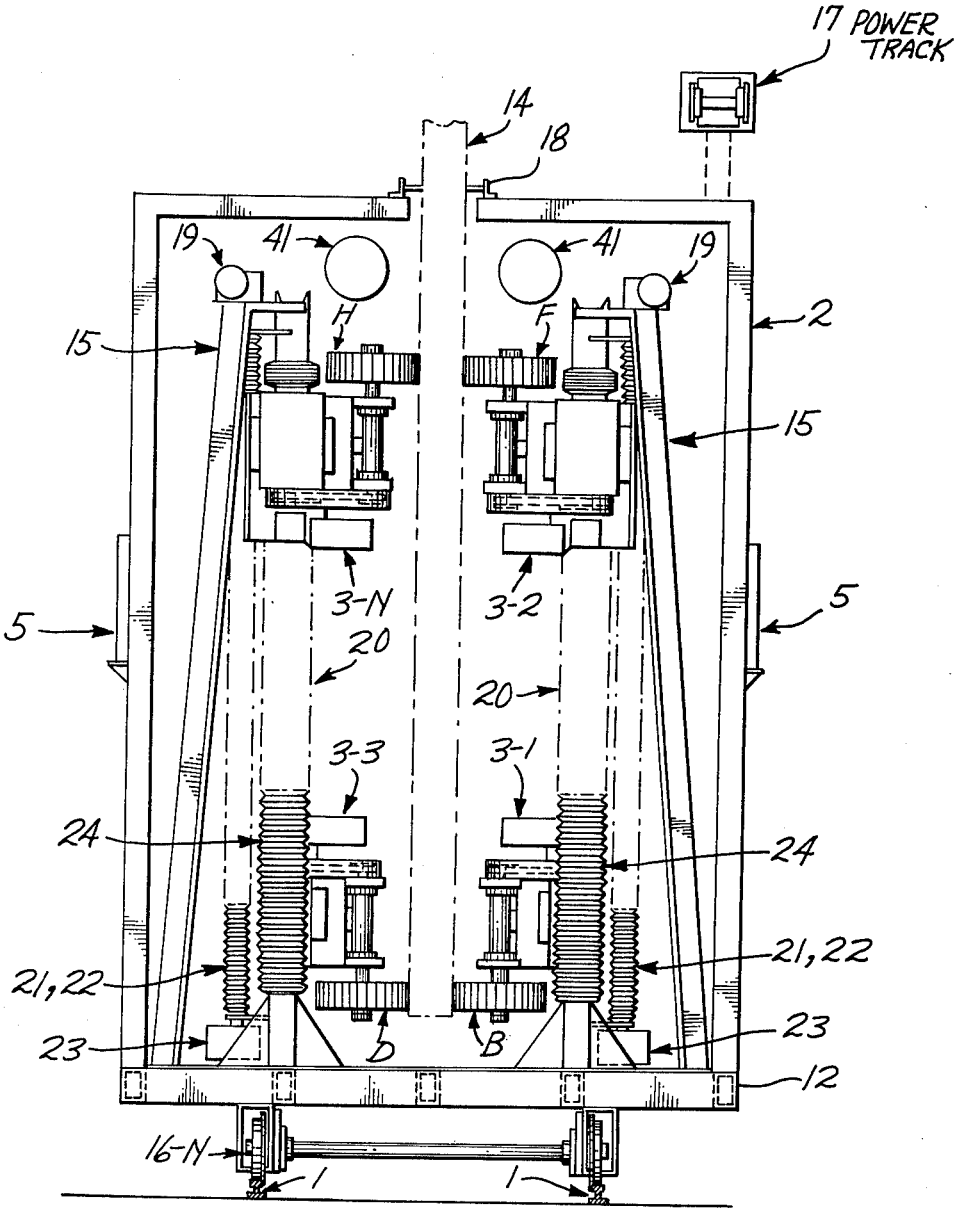
FIG. 3 is an end view of the present sanding system showing rails and movable power track system.
Figure 4:
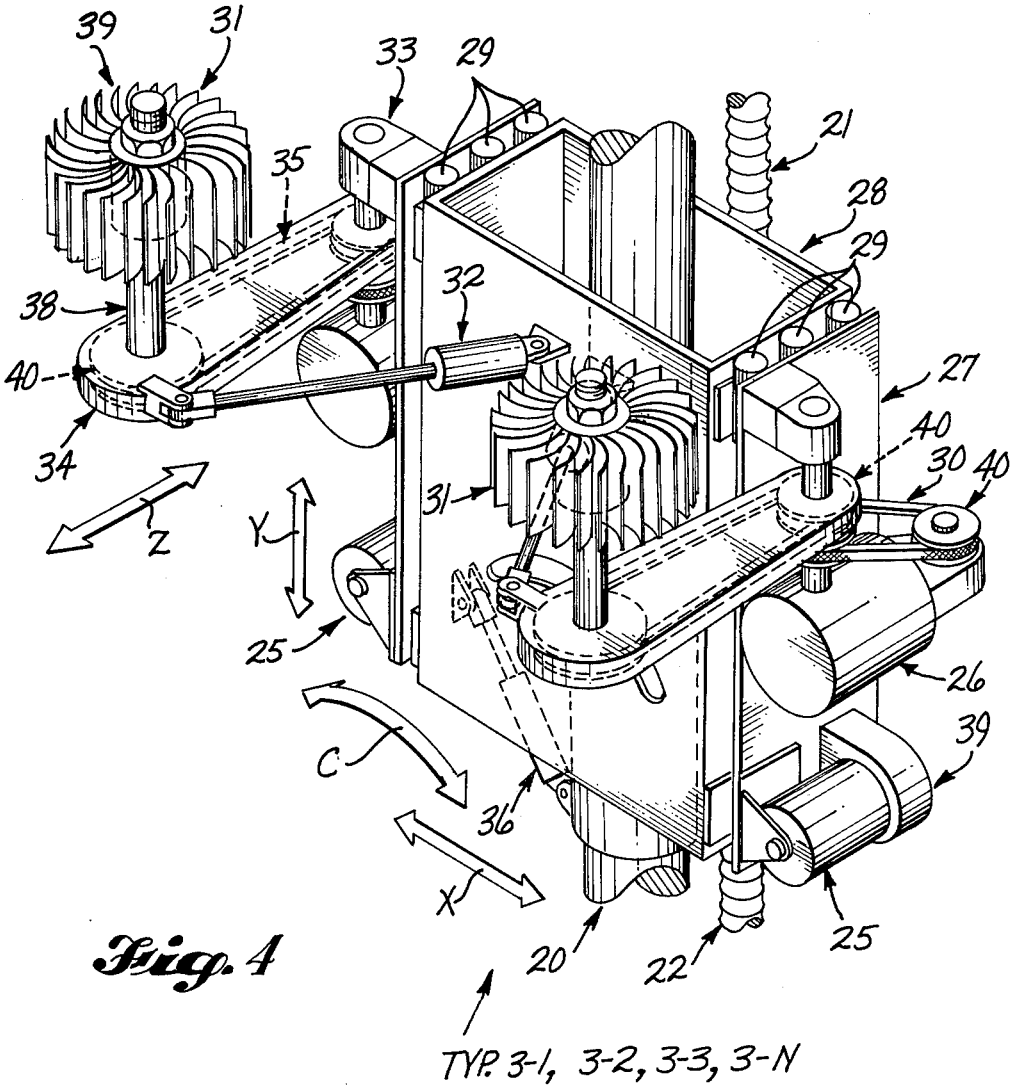
FIG. 4 is a detailed view of one of the sanding head assemblies of the present system demonstrating the four axes movement of each assembly.

The operators observe the sanding operation through two bullet-proof windows 43, while variable speed drive motor 7 provides motive power in the X motion through gear box 8, chain drive 16 and idlers 25 to the driven set of trucks 16 illustrated in detail in FIGS. 2 and 3.

Only three sets of trucks 16 have been shown in the FIGURES; however, it can be understood that as many may be added as required, and they are further identified by numbers 1, 2, . . . N. The machine rolls on a set of rails 1 down the length of the part 14 with power, control signals, water, and air provided through an overhead power track system 17 as e.g. manufactured by Gelco Inc. Each sanding station consists of two counter-rotating sanding wheels 31, each consisting of abrasive segments such as those available from Merit Abrasives Co. (individually marked A–H on FIGS. 1, 2, 3, and on the control console 6). These sanding wheels are driven through an articulated arm mechanism consisting of sleeves 40, double belt drives 30, belt guards 34, pillow blocks 33, and spindles 38 by electric motor 26. This assembly is mounted onto baseplate 27 and suspended on three shafts 29 with guide bushings and counterbalancing springs, the counterbalancing springs being required to allow the entire baseplate 27 and assembly to oscillate over a variable range and frequency independent of the main weldment 28. This variable amplitude and frequency oscillation is controlled by the oscillation motor 25 through a right angle gear box 39 to a spring loaded eccentric cam as shown in FIG. 7. The articulation, or Z motion, is controlled by an air pressure system 32 individually controlled from the respective control console 6. The air pressure system is designed to allow for a deviation in part 14 thickness without an associated variation in wheel/part contact pressure. Uniform air pressure for the Z motion is provided through the surge resistor tank 24. The C, or radial, motion is controlled by an electrically operated activator. This causes the entire sanding station 3 to vary in perpendicularity from the line created by the column 20. The entire sanding station 3 is vertically adjustable along the length of column 20 in the Y motion, driven by the ball screw 21 and motor 19. Dust protection for all sliding assemblies is provided by rubber bellows such as 22 and 24.

Height, or Y position, is indicated by optical encoders 23, radial, or C, position by optical encoders 45, with X position indicated by optical encoder 46.

The guide roll stations 4 are composed of a flexible roll 47, bracket 50, and an electrically operated activator 48, all mounted to the weldment 49 and fastened to the trolley deck 42.

I claim:

1. A manually controlled system for finishing vertically being rolled, machined, or blasted stationary parts of varying length, width, height, with varying contours by means of abrasive wheels:

said system including at least one sanding station having abrasive wheels, a dust and sound enclosure, a plurality of operator consoles, and dust collecting means, said at least one sanding station having abrasive wheels, dust and sound enclosure, plurality of operator consoles, and dust collecting means disposed on a common trolley for travelling a linear path over a predetermined distance;

said system having a system horizontal axis and including an opening bisecting said system along the horizontal axis for providing finishing of said stationary parts on both sides of said stationary parts; and, said system also including mechanical means of propulsion for the system and guide rolls for stabilizing, and directing said stationary parts by said abrasive wheels.

2. A manually controlled system for finishing vertically being rolled, machined, or blasted moving parts of varying length, width, height, and contour by means of abrasive wheels:

said system including at least one sanding station having abrasive wheels, a dust and sound enclosure, a plurality of operator consoles, and dust collecting means, said at least one sanding station having abrasive wheels, dust and sound enclosure, plurality of operator consoles, and dust collecting means disposed on a common trolley for travelling a linear path over a predetermined distance;

said system having a system horizontal axis and including an opening bisecting said system along the horizontal axis for providing finishing of said moving parts on both sides of said moving parts; and, said system also including mechanical means of propulsion for the system and guide rolls for stabilizing, and directing said moving parts by said abrasive wheels.

3. An automatically controlled system according to claims 1 or 2 for finishing vertically being rolled, machined, or blasted stationary parts of varying length, width, height, and contour by means of abrasive wheels, and further including control means including position indicators providing control functions in said system.

4. A manually controlled system according to claim 1 wherein said dust and sound enclosure has top, front, and rear sides; and, said manually controlled system further comprises a brush mounting system surrounding said dust and sound enclosure on said top, front, and rear sides.

5. A manually controlled system according to claim 1 wherein said common trolley is adapted to roll upon a floor-mounted rail system.

6. A manually controlled system according to claim 1 wherein said at least one sanding station having abrasive wheels comprises two counter-rotating wheels mounted in a column in the same plane.

7. A manually controlled system according to claim 2 wherein said guide rolls comprise a plurality of sets of guide rolls distributed at staggered heights along the horizontal axis of said system for dampening sympathetic vibration of said moving parts.

8. A manually controlled system according to claim 2 further including means for oscillating said abrasive wheels over a variable amplitude and frequency.

* * * * *